US008490695B2

(12) United States Patent
Bahorich et al.

(10) Patent No.: US 8,490,695 B2
(45) Date of Patent: Jul. 23, 2013

(54) METHOD FOR DRILLING AND FRACTURE TREATING MULTIPLE WELLBORES

(75) Inventors: Michael S. Bahorich, Houston, TX (US); Mark E. Bahorich, Houston, TX (US); Benjamin L. Bahorich, Houston, TX (US); Eric J. Bahorich, Houston, TX (US)

(73) Assignee: Apache Corporation, Houston, TX (US)

( * ) Notice: Subject to any disclaimer, the term of this patent is extended or adjusted under 35 U.S.C. 154(b) by 325 days.

(21) Appl. No.: 13/021,959

(22) Filed: Feb. 7, 2011

(65) Prior Publication Data

US 2011/0192601 A1 Aug. 11, 2011

Related U.S. Application Data

(60) Provisional application No. 61/302,199, filed on Feb. 8, 2010.

(51) Int. Cl.
*E21B 43/26* (2006.01)
*E21B 33/10* (2006.01)

(52) U.S. Cl.
USPC ..... 166/271; 166/245; 166/52; 166/308.1; 166/285

(58) Field of Classification Search
USPC ..... 166/245, 50, 52, 313, 308.1, 271, 166/177.5, 285
See application file for complete search history.

(56) References Cited

U.S. PATENT DOCUMENTS

| | | | | | |
|---|---|---|---|---|---|
| 3,223,158 | A * | 12/1965 | Baker | 166/259 |
| 3,682,246 | A * | 8/1972 | Closmann | 166/271 |
| 4,022,279 | A * | 5/1977 | Driver | 166/271 |
| 4,676,313 | A * | 6/1987 | Rinaldi | 166/252.1 |
| 4,834,181 | A * | 5/1989 | Uhri et al. | 166/281 |
| 5,238,067 | A * | 8/1993 | Jennings, Jr. | 166/307 |
| 6,012,520 | A * | 1/2000 | Yu et al. | 166/245 |
| 7,370,696 | B2 * | 5/2008 | Al-Muraikhi | 166/50 |
| 8,113,272 | B2 * | 2/2012 | Vinegar | 166/60 |
| 8,141,638 | B2 * | 3/2012 | Tulissi et al. | 166/281 |
| 2006/0157242 | A1 * | 7/2006 | Graham et al. | 166/268 |
| 2009/0090499 | A1 * | 4/2009 | Lewis et al. | 166/52 |

* cited by examiner

*Primary Examiner* — Kenneth L Thompson
(74) *Attorney, Agent, or Firm* — Richard A. Fagin

(57) ABSTRACT

A method for drilling and completing multiple wellbores in a subsurface rock formation includes drilling a first wellbore along a first selected trajectory through the rock formation. The first wellbore is fracture treated and then abandoned. A second wellbore is drilled along a second selected trajectory through the rock formation. The second trajectory is laterally spaced from the first trajectory. The second wellbore is then fracture treated and abandoned. A third wellbore is drilled along a third selected trajectory through the rock formation. The third trajectory is disposed between the first and second trajectories. The third wellbore is fractured treated such that a fracture network extending therefrom hydraulically connects to fracture networks extending from the first and second wellbores.

7 Claims, 2 Drawing Sheets

Step 6
frac third lateral to connect
to reservoir hydrocarbons
in previously frac'ed laterals New method of multilateral completion In tight formations

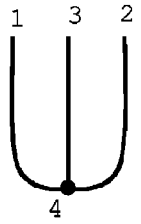

map view of multi-lateral well

FIG. 1
PRIOR ART

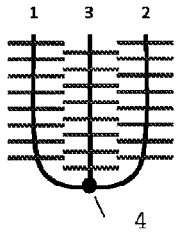

map view of multi-lateral well after 8 frac stages in each lateral

FIG 1A
PRIOR ART

FIG. 2

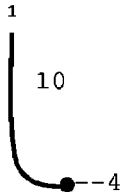

Step 1
drill first lateral

FIG. 3

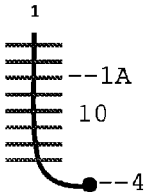

Step 2
frac first lateral

FIG. 4

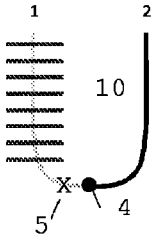

Step 3
abandon first lateral, drill second lateral

FIG. 5

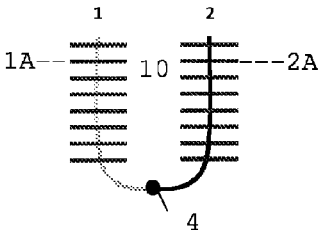

Step 4
frac second lateral

FIG. 6

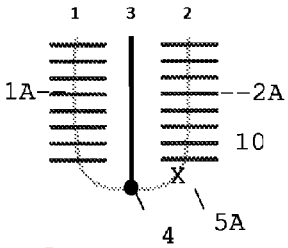

Step 5
abandon second lateral, drill third lateral

FIG. 7

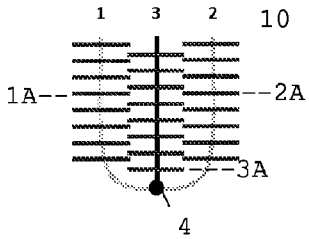

Step 6
frac third lateral to connect to reservoir hydrocarbons in previously frac'ed laterals

METHOD FOR DRILLING AND FRACTURE TREATING MULTIPLE WELLBORES

CROSS-REFERENCE TO RELATED APPLICATIONS

Priority is claimed from U.S. Provisional Application No. 61/302,199 filed on Feb. 8, 2010.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling and completion of multiple, highly inclined wellbores through subsurface rock formations. More specifically, the invention relates to methods for using a plurality of highly inclined wellbores to create a subsurface fracture network in a low permeability subsurface formation.

2. Background Art

Extraction of oil and/or gas from certain subsurface rock formations requires creating a network of wellbores extending laterally through the formation. The network of wellbores increases the effective drainage capacity. For certain low permeability formations, such as gas bearing shales, extending such networks of wellbores has made possible extraction of oil and/or gas from such formations to be commercially profitable.

FIG. 1 shows a plan view of an example multiple lateral wellbore network. Generally such a network is made by drilling a substantially vertical wellbore 4 from a convenient surface location. At a selected depth, the trajectory of the wellbore may be diverted from the surface location of the vertical wellbore, and then laterally (along the bedding planes of the target formations) into the target formation along a selected length. FIG. 1 shows three such wellbores 1, 2, 3 each originating from the vertical wellbore.

FIG. 1A shows the three lateral wellbores 1, 2, 3 after hydraulic fracture treatment thereof. At selected positions along each lateral wellbore 1, 2, 3, fracturing fluid containing proppant is pumped into each wellbore to create a permeable channel extending laterally outward from the wellbore. Fracturing also extends the effective drainage radius of each wellbore as a result of connecting the permeable channels to each wellbore.

A drawback to the multiple lateral wellbore network shown in FIGS. 1 and 1A is the risk of failure of one or more of the wellbores. Such failure may substantially reduce the production of oil and/or gas from the subsurface formation.

SUMMARY OF THE INVENTION

A method according to one aspect of the invention includes drilling and completing multiple wellbores in a subsurface rock formation. The method includes drilling a first wellbore along a first selected trajectory through the rock formation. The first wellbore is fracture treated and then abandoned. A second wellbore is drilled along a second selected trajectory through the rock formation. The second trajectory is laterally spaced from the first trajectory. The second wellbore is then fracture treated and abandoned. A third wellbore is drilled along a third selected trajectory through the rock formation. The third trajectory is disposed between the first and second trajectories. The third wellbore is fractured treated such that a fracture network extending therefrom hydraulically connects to fracture networks extending from the first and second wellbores.

Other aspects and advantages of the invention will be apparent from the following description and the appended claims.

BRIEF DESCRIPTION OF THE DRAWINGS

FIG. 1 shows a plan view of a multiple lateral wellbore.

FIG. 1A shows a multiple lateral wellbore after fracture treatment.

FIG. 2 shows drilling a first wellbore according to the invention.

FIG. 3 shows fracture treating the first wellbore.

FIG. 4 shows abandoning the first wellbore and drilling a second wellbore.

FIG. 5 shows fracture treating the second wellbore.

FIG. 6 shows abandoning the second wellbore and drilling a third wellbore generally disposed between the first and second wellbores.

FIG. 7 shows fracture treating the third wellbore to connect the fracture networks created in the first and second wells.

DETAILED DESCRIPTION

Figure 8:
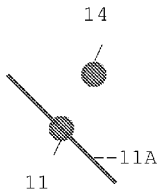
FIGS. 8, 9 and 10 show, respectively, a procedure used on wellbores drilled and substantially vertically though a reservoir and subsequent treatment as used in the multiple lateral procedure shown in FIGS. 2 through 7.

FIG. 2 shows an initial step in creating a reservoir drainage network according to the invention. A first wellbore 1 may be drilled from a selected surface location, substantially as explained in the Background section herein, into a target subsurface formation 10. The first wellbore 1 may be a lateral or horizontal wellbore drilled from an existing or concurrently drilled substantially vertical wellbore from the selected surface location 4. The existing or concurrently drilled wellbore may also be inclined from vertical. For purposes of defining the scope of the present invention, the term "lateral" as used herein to describe wellbore trajectory means that the wellbore trajectory generally remains within a selected rock formation that may extend along a determinable inclination angle (dip), and generally extends a selected horizontal distance from the surface location. The trajectory of any wellbore may therefore be horizontal, or may be inclined, depending on the geologic structure of the formation through which the wellbore is drilled.

In FIG. 3, the first wellbore 1 may be fracture treated after drilling is completed to create a fracture network 1A extending laterally into the formation from the first wellbore 1. The fracture network 1A is generally transversely oriented with respect to the longitudinal axis of the first wellbore 1, and may follow the geologic structure of the target formation 10. In FIG. 4, the first wellbore 1 may be abandoned, such as by plugging. Plugging may be performed by setting a wellbore plug 5, e.g., a mechanically operated radially expanding seal element, at a selected depth in the first wellbore 1, followed by inserting cement into the wellbore above the plug 5. Typically the plug 5 is set at a wellbore depth shallower than the wellbore depth of the fracture network 1A, but below the bottom of the vertical portion of the wellbore extending from the surface location 4 so that other wellbores may be drilled from the same surface location 4. "Wellbore depth" as used in the present context may be understood at the length along the first wellbore 1 from the surface location 4. Such length is known in the art as "measured depth." As will be appreciated by those skilled in the art, "measured depth" of a wellbore is directly related to the vertical depth of the wellbore if the trajectory is essentially vertical, but a horizontal portion of such a wellbore may sustain no change in vertical depth, while the length or measured depth increases with wellbore length.

After plugging the first wellbore 1 a second wellbore 2, which may also be a lateral wellbore may be drilled into another part of the target formation 10. The second wellbore 2 may also generally follow the geologic structure of the target formation 10, and may laterally displaced from the first wellbore 1 by a selected lateral distance and extend generally parallel to the first wellbore 1. The selected lateral distance between the first wellbore 1 and the second wellbore 2 may be selected such that the fracture network 1A extending from the first wellbore 1 does not connect directly to a fracture network (explained below) that will be created in the second wellbore 2.

In FIG. 5, after drilling the second wellbore 2 through the target formation 10 is completed, the second wellbore 2 may be fracture treated to create a fracture network 2A extending laterally from the second wellbore 2, similar to the fracture network 1A extending from the first wellbore 1. In FIG. 6, the second wellbore 2 is abandoned, such as by plugging (e.g., setting a plug 5A and cementing above the plug) and a third wellbore 3 may be drilled through the target formation 10.

Preferably, the third wellbore 3 is drilled along the target formation in a lateral position between the fracture networks 1A, 2A created previously by fracture treating the first 1 and second 2 wellbores. Finally, in FIG. 7, the third wellbore 3 may be fracture treated such that a fracture network 3A is generated which substantially hydraulically connects the first 1A and second 2A fracture networks. Thus, the target formation 10 is hydraulically in communication with the entire drainage area of three fracture networks 1A, 2A, 3A, while being connected to only one wellbore, that being the third wellbore in the present example. Fluids such as oil and/or gas may be extracted from the target formation 10 using the connected wellbore, e.g., the third wellbore 3 in the present example.

Any or all of the first 1, second 2 and third 3 wellbores may be completed in the target formation 10 prior to fracture treating by cementing in place therein a pipe such as a casing or liner followed by perforation of the liner or casing within the target formation 10, that is, where each wellbore intersects the target formation 10. The wellbores 1, 2, 3 may alternatively be completed using a slotted pipe or liner, or may be "open hole" completed such as by filling with gravel or similar high permeability material. As will be appreciated by those skilled in the art, the completion technique used in any particular wellbore may depend on the mechanical properties of the target formation and the type of fracture treatment used to create the respective fracture networks.

Depending on the composition and structure of the target formation 10, the first 1 and/or second 2 wellbores may be hydraulically connected to equipment (not shown) at the surface for the purpose of flow back and well cleanup procedures typically associated with fracture treatment of wellbores. The timing of such flow back and cleanup procedures may be such that the plugs 5, 5A are removed from the first and/or second wellbores to enable such procedures. Alternatively, the first 1 and/or second 2 wellbores may be flowed back and cleaned up prior to setting the plugs, 5, 5A, respectively and abandonment thereof.

In some examples, any two or all of the three wellbores described above may be drilled from a common or "pilot" vertical wellbore drilled to a selected depth above the target formation 10. Non-limiting example procedures and devices for drilling multiple lateral wellbores from a single pilot wellbore are described in U.S. Pat. No. 5,785,133 issued to Murray et al. and in U.S. Pat. No. 5,735,350 issued to Longbottom et al., both of which are incorporated herein by reference.

Figure 9:
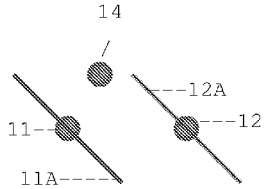
Figure 10:
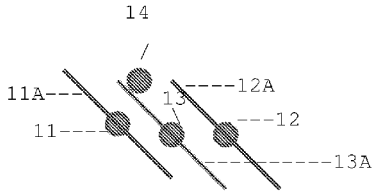

It will be appreciated by those skilled in the art that the procedure explained above with reference to lateral wellbores may also be performed using "vertical" wellbores, that is wellbores that penetrate the formation of interest (e.g., target formation 10) substantially perpendicularly to the bedding planes (geologic structure) of the rock formation of interest. Accordingly, the invention is not limited in scope to lateral wellbores drilled through such formations. An example of such procedure may be better understood with reference to FIGS. 8 through 10. In FIG. 8, a first wellbore may be drilled from a surface location 14 at a selected geodetic position with reference to a reservoir formation (e.g., 10 in FIGS. 2 through 7). The wellbore in FIG. 8 may be directionally drilled so that its geodetic location at the reservoir level (i.e., vertical depth), shown at 11, may be displaced from the surface location 14. The first wellbore may also be substantially vertically drilled. The first wellbore may be fracture treated to create a fracture network 11A, and subsequently abandoned as explained with reference to FIG. 4. A second wellbore may be directionally drilled from the surface location 14 or from another surface location (not shown), or may be vertically drilled from another surface location so that its geodetic position at the reservoir level, shown at 12, is laterally displaced from the reservoir level location 11 of the first wellbore. The second wellbore may be subsequently fracture treated to create a fracture network 12A, and subsequently abandoned as explained with reference to FIG. 5. A third wellbore may then be drilled from the surface location 14 or from another surface location (not shown) and directionally or vertically drilled so that its geodetic location at the reservoir level 13 is disposed between the geodetic locations at the reservoir level of the first wellbore 11 and the second wellbore 12. The third wellbore may be fracture treated as explained with reference to FIG. 7 to create a fracture network 13A. The third wellbore may then be used for production of hydrocarbons from the reservoir formation (e.g., 10 in FIG. 2). As in the lateral wellbore example, either or both of the first and second wellbores may be flowed back and cleaned for a selected period of time prior to abandonment to assist in production from the respective fracture networks 11A, 12A. It should also be noted that in the present example any one or more surface geodetic locations may be used to initiate the drilling of any of the wellbores. Any of the wellbores may be vertically drilled if the surface location thereof is directly above the intended wellbore geodetic location at the reservoir level, or any of the wellbores may be directionally drilled if it is desired to have the surface location displaced from the reservoir level location. In any of the foregoing examples described with reference to FIGS. 8 through 10, the wellbore trajectory may be substantially vertical at the reservoir level.

A method for drilling and fracture treating multiple wellbores according to the invention can provide production rates close to those of multiple lateral wellbores while substantially reducing the risk of production loss by reason of failure of one or more lateral wellbores.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for drilling and completing multiple wellbores in a subsurface rock formation, comprising:

drilling a first wellbore along a first selected trajectory through the rock formation;

fracture treating the first wellbore;

abandoning the first wellbore by setting a plug therein at a wellbore depth above the rock formation;

drilling a second wellbore along a second selected trajectory through the rock formation, the second trajectory laterally spaced from the first trajectory;

fracture treating the second wellbore;

abandoning the second wellbore by setting a plug therein at a wellbore depth above the rock formation;

drilling a third wellbore along a third selected trajectory through the rock formation, the third trajectory disposed between the first and second trajectories; and fracture treating the third wellbore such that a fracture network extending therefrom hydraulically connects to fracture networks extending from the first and second lateral wellbores.

2. The method of claim 1 wherein the first, second and third wellbores are lateral wellbores drilled from a same surface location.

3. The method of claim 1 wherein the trajectory of the first, second and third wellbores substantially follows a bedding plane of the rock formation.

4. The method of claim 1 wherein the trajectory of the first, second and third wellbores is substantially vertical through the rock formation.

5. The method of claim 1 further comprising flow back and cleanup of at least one of the first and second wellbores.

6. The method of claim 5 wherein the flow back and cleanup is performed prior to the abandonment.

7. The method of claim 5 wherein the flow back and cleanup is performed after the abandonment.

* * * * *